US005189739A

United States Patent [19]

Thierry

[11] Patent Number: 5,189,739

[45] Date of Patent: Mar. 2, 1993

[54] TOILET SEAT FOR AN INVALID

[76] Inventor: Timothy J. Thierry, 23357 Bassett St., West Hills, Calif. 91307

[21] Appl. No.: 763,285

[22] Filed: Sep. 20, 1991

[51] Int. Cl.[5] ..... A47K 13/00

[52] U.S. Cl. ..... 4/254; 4/237

[58] Field of Search ..... 4/237, 254; 297/337, 297/344

[56] References Cited

U.S. PATENT DOCUMENTS

| | | | |
|---|---|---|---|
| 2,713,688 | 7/1955 | Johnson | 4/237 |
| 3,060,458 | 10/1962 | Burke | 4/237 |
| 3,458,872 | 8/1969 | Hellstrom et al. | 4/237 |
| 3,473,174 | 10/1969 | Cool | 4/251 |
| 4,168,552 | 9/1979 | Austin | 4/237 |
| 4,185,335 | 1/1980 | Alvis | 4/251 |
| 4,581,778 | 4/1986 | Pontoppidan | 4/251 |
| 4,777,671 | 10/1988 | Kearns | 4/251 |
| 4,833,736 | 5/1989 | Sadler et al. | 4/251 |
| 4,993,085 | 2/1991 | Gibbons | 4/251 |

FOREIGN PATENT DOCUMENTS

658783A5 12/1986 Switzerland .

*Primary Examiner*—William A. Cuchlinski, Jr.
*Assistant Examiner*—W. Morris Worth
*Attorney, Agent, or Firm*—Lewis Anten

[57] ABSTRACT

A movable toilet seat, the seat portion of which remains horizontal while raising and lowering. An upper frame capable of having a common toilet seat attached raises and lowers with respect to a lower frame. The lower frame provides support for the upper frame and is attached to the toilet. When the upper frame is raised, it also travels forward to allow more clearance from the toilet for the user. When the upper frame is lowered, it travels back to situate the user directly over the toilet bowl. Preferably, a reversible motor is used to raise and lower the upper frame. However, alternative embodiments encompass the use of an air shock absorber and a manual jack.

9 Claims, 10 Drawing Sheets

TOILET SEAT FOR AN INVALID

BACKGROUND OF THE INVENTION

1. Field of the Invention

This invention relates to sanitary fixtures, and more particularly to a toilet seat mechanism that raises and lowers to enable an invalid or disabled person to more easily use a toilet.

2. Description of the Related Art

There have been many devices addressing the problems encountered by an invalid or disabled person when using a toilet. Joint frailty, muscle weakness, or overall fatigue may be responsible for this.

In the past, there have been movable toilet seats that bring the toilet seat to the invalid, and then bring the two together down to the toilet. Generally, these have been variations of two solutions: movable toilet seats that raise vertically, and movable toilet seats that raise vertically and tilt forward.

For those movable toilet seats that raise vertically, users must negotiate themselves out from over the toilet. This can present problems to the user as the circumstances that led to the use of a movable toilet seat in the beginning, may also prevent them from ably removing themselves from the vertically upraised toilet seat.

Movable toilet seats that raise vertically and tilt forward result in additional problems. When a seated person has the seat tilted forward, there is a tendency for the seated person to pitch forward. While this usually presents no problems for those with adequate muscle control and coordination, for invalids, pitching forward can mean a loss of control and possible injury. Also, the invalid must keep his balance while being set on his feet. While it is often a simple matter for a person to keep his balance once it is established, a tilting toilet seat often sets the user on his feet before his balance is established. The user must then lean upon the tilting toilet seat while trying to prevent his feet from slipping out from underneath him. For invalids, this can be difficult and misjudgment or lack or coordination during this unseating process can lead to possible injury.

It is seen that while vertically elevating and/or vertically elevating and tilting movable toilet seats allow some users more convenience in using the toilet, there are still problems to be overcome and solutions to be sought. One such solution would have the toilet seat presented to the user in a manner that did not require the user to lean against the toilet seat while being seated or unseated. Instead, such a movable toilet seat would allow a stable fixture upon which the user could rely while seating himself upon the toilet seat. Once seated, the user would then be brought to the toilet by the movable seat while remaining seated. Once finished, the user would then be raised vertically and brought forward away from the toilet while remaining seated. Such a solution is embodied in the invention set forth in this patent.

SUMMARY OF THE INVENTION

An upper frame provides a structure to which a regular toilet seat can be attached. A lower frame is connected to the upper frame by connection means that are pivotally attached to both the upper and lower frames. The connection means can be struts that are pivotally connected to both the upper and lower frames. When the upper frame is moved relative to the lower frame, the upper frame moves up from and forward of its original resting position adjacent to the lower frame. The connection means keep the upper frame horizontal at all times so that a person seated upon the toilet seat attached to the upper frame can remain securely and stably seated. The lower frame is connected to the toilet and rests upon the floor.

Means for raising and lowering the upper frame (thereby moving it relative to the lower frame) are connected to the upper frame. In the preferred embodiment, such means is automatic and includes a motor and an air shock absorber.

When the user wants to use the movable toilet seat, he raises the upper frame having the seat portion and seats himself upon the toilet seat and upper frame while they are in their forward, upraised position. The upper frame is then lowered by means of a switch which controls the motor. The upper frame is set back to a position adjacent to the lower frame, that position being immediately over the toilet bowl. Upon finishing use of the toilet, the user engages the moving means again to raise the upper frame back to the first, upraised position. Once raised, the user then dismounts the upper frame and toilet seat.

OBJECTS OF THE INVENTION

It is an object of this invention to provide a toilet seat that is easier for an invalid to use.

It is another object of this invention to provide a movable toilet seat that is safer.

It is another object of this invention to provide a movable toilet seat that is more reliable.

These and other objects and advantages of the present invention will be apparent from a review of the following specification and accompanying drawings.

DESCRIPTION OF THE PREFERRED EMBODIMENT(S)

Figure 1:
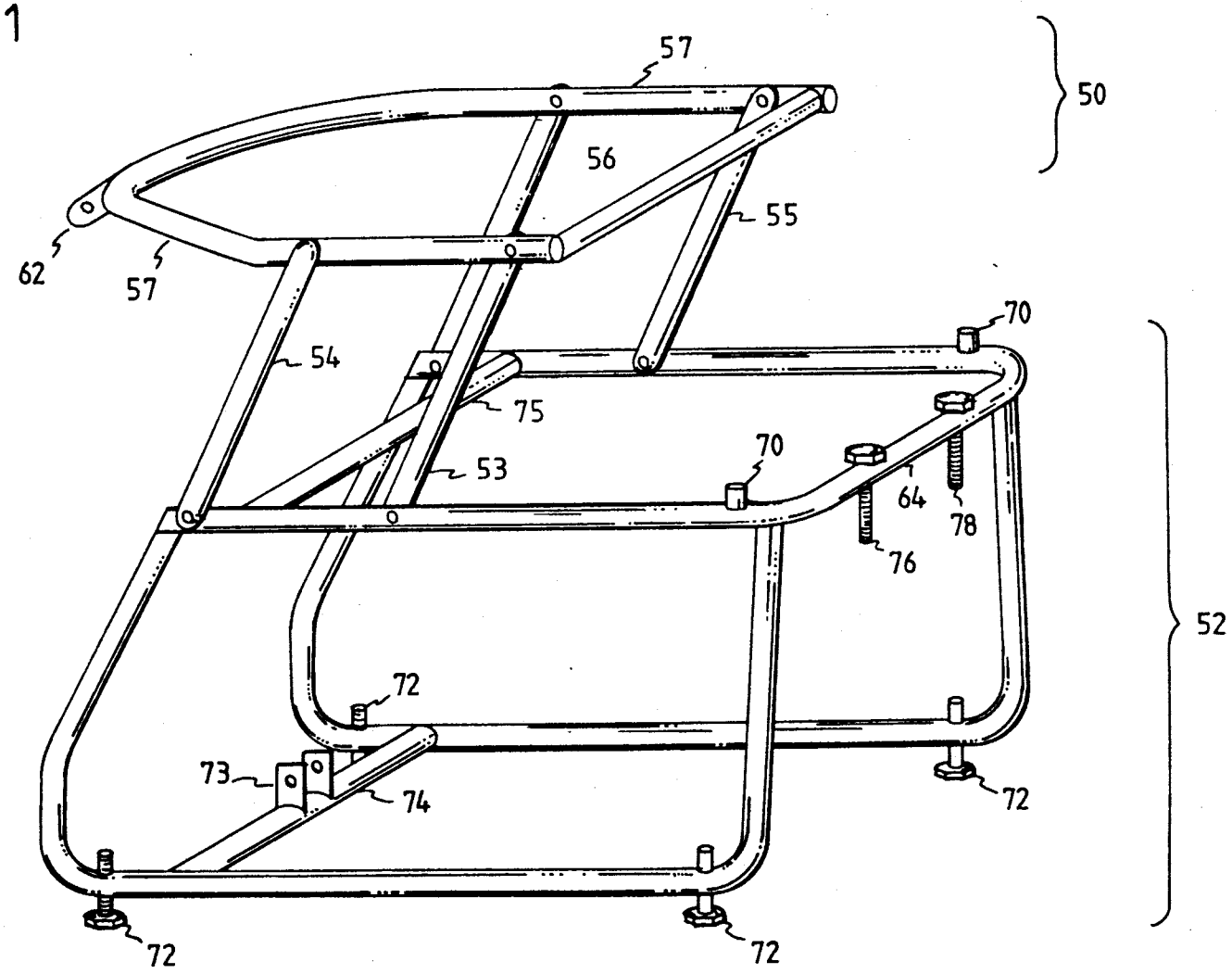
FIG. 1 shows a perspective view of the present invention in a raised position without means for raising or lowering the upper frame.

Referring generally to FIGS. 1–4, the present invention has an upper frame 50 and a lower frame 52. The upper frame 50 is connected to the lower frame 52 by means of four struts 53, 54, 55, 56, each of equal length. Preferably, the toilet seat mechanism is constructed from three-quarter inch tubular stainless steel. Circular stainless steel tubing is preferred over square tubing as the circular tubing withstands bending better without crimping.

The upper frame 50 has an upper frame base 57 to which are connected two handles 58, 60. A housing 62 is attached to the front of the base 57.

The lower frame 52 has a lower frame base 64 to which are attached two leg structures 66, 68. Resting posts 70 are also attached to the lower frame base 64. The resting posts 70 are three-quarters of an inch high and are used to slightly lift and hold the upper frame 50 above the lower frame 52 so that the upper frame 50 is more easily raised at the start.

Adjustable legs 72 are attached to the two leg structures 66, 68. A lower cross bar 74 connects the two leg structures 66, 68 to provide structural integrity and to provide means (such as a bracket 73) for attaching a motor or the like to raise and lower the upper frame 50. Likewise, an upper cross bar 75 is present in the lower frame base 64.

The struts 53–56 each form parallelograms on their respective sides of the apparatus and do not pass through an angle exceeding ninety degrees with respect to the lower frame base 64 in order to prevent over-articulation. As the struts 53–56 form parallelograms with the upper 57 and lower 64 frame bases, even though the struts 53–56 pivot on the upper 57 and lower 64 frame bases, all sides of the parallelograms so formed remain parallel to their opposite side. From this, the upper frame base 57 remains level throughout its travel from adjacent to lower frame 52 to its fully raised position, although there is some movement or "play" within the joints of the parallelogram formed by the struts 53–56. The forward struts 54, 56 are shown connected to the outside of the frames 50, 52, while rear struts 53, 55 are shown connected to the inside of the frames 50, 52.

The movable toilet seat is attached to the toilet by two bolts 76, 78 that fit into the back of the commode portion of the toilet where the bolts for the toilet seat normally sit.

The height the upper frame 50 attains is determined by the length of the struts 53–56 and the angle to which the struts 53–56 are moved relative to the lower frame 52. The height of the upraised upper frame 50 should be approximately as high as the user's hips, and may be situated slightly below the hips to facilitate mounting.

The height may be adjusted by using struts 53–56 of different lengths connected to the frames 50, 52 at correspondingly adjusted positions. However, such adjustment of the struts forces the upper frame 50 to seat itself differently over the lower frame 52. Height adjustment is better accomplished through adjustable legs 72 (with corresponding adjustment of bolts 76 and 78), or through selectable height adjustment of the upper frame 50 when being raised or lowered by the user. A larger individual may raise the upper frame 50 to a higher position than a smaller individual so that the adjustable seat can accommodate all types and sizes of persons.

Figure 3:
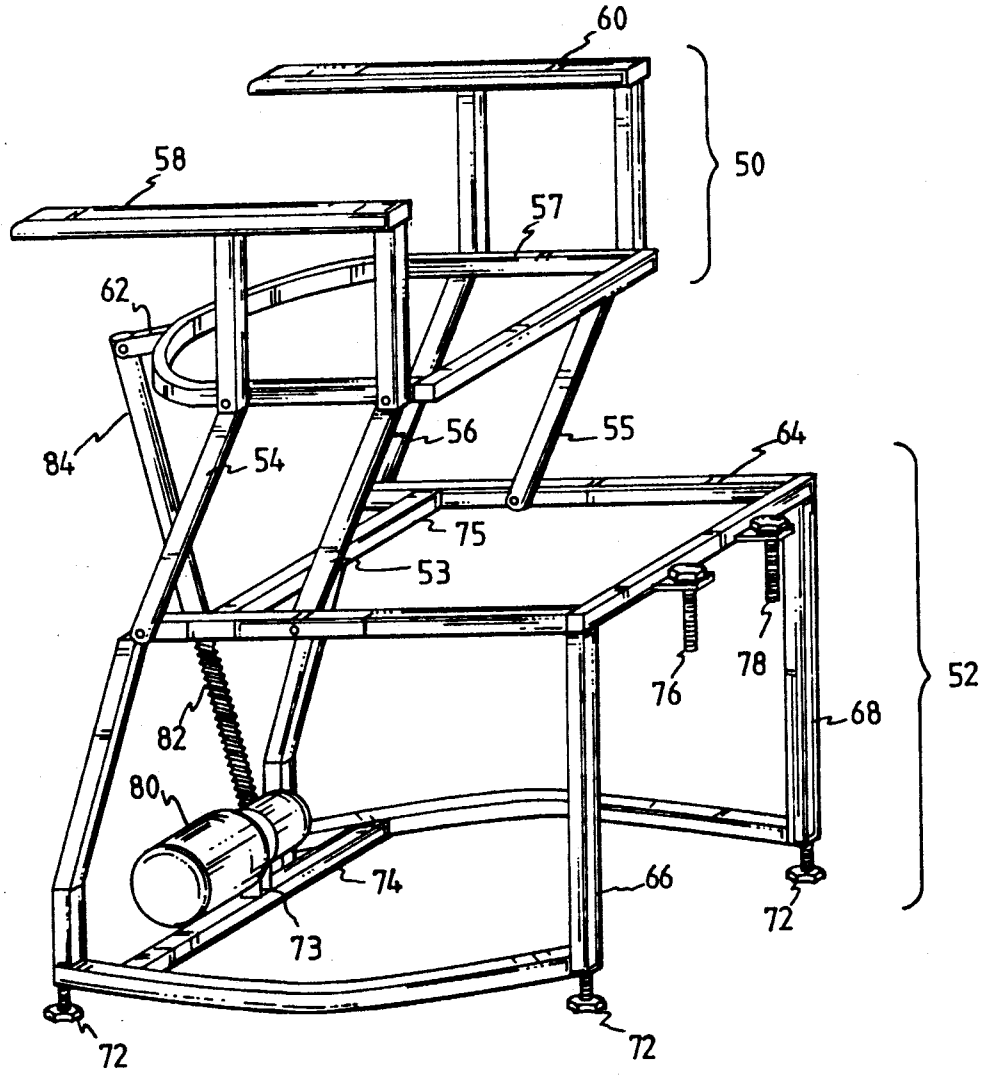
FIG. 3 shows a perspective view of a preferred embodiment of the present invention incorporating a motor for lifting the upper frame.

Referring to FIG. 3, the preferred embodiment of the present invention is shown in its raised position, without a toilet, and with a reversible motor 80. The reversible motor 80 turns a screw 82 that forces a screw follower 34 up or down according to the turning of the screw 82. The screw follower 84 is pivotally connected to the upper frame 50 at the housing 62. A line and switch (both not shown) control the reversible motor 80 to turn the screw 82 either clockwise or counter-clockwise, which raises or lowers the upper frame 50.

Figure 7:
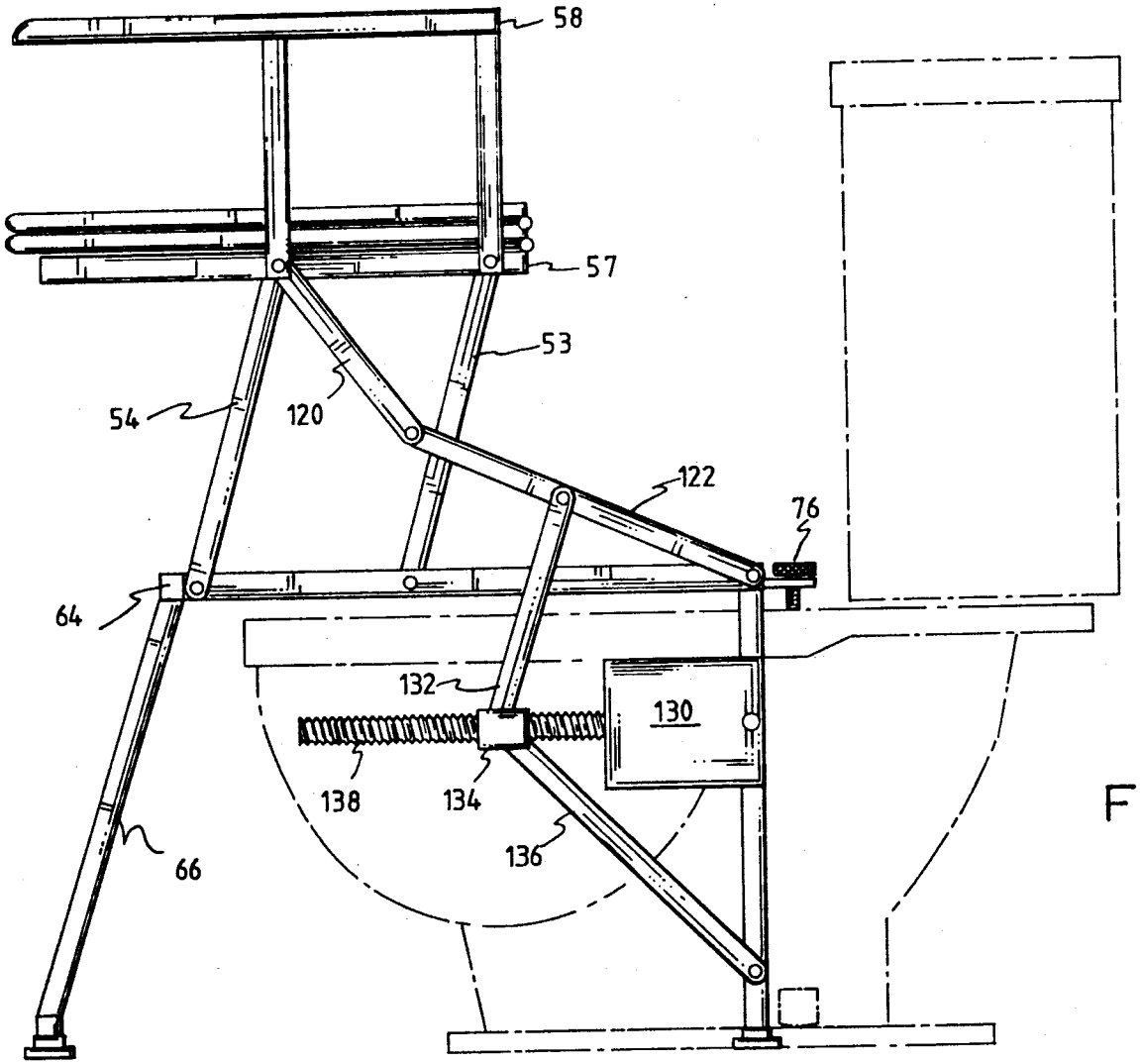
FIG. 7 is a side plan view of an alternative embodiment of the present invention showing the upper frame raised and a single side mechanism for raising and lowering the upper frame.
Figure 8:
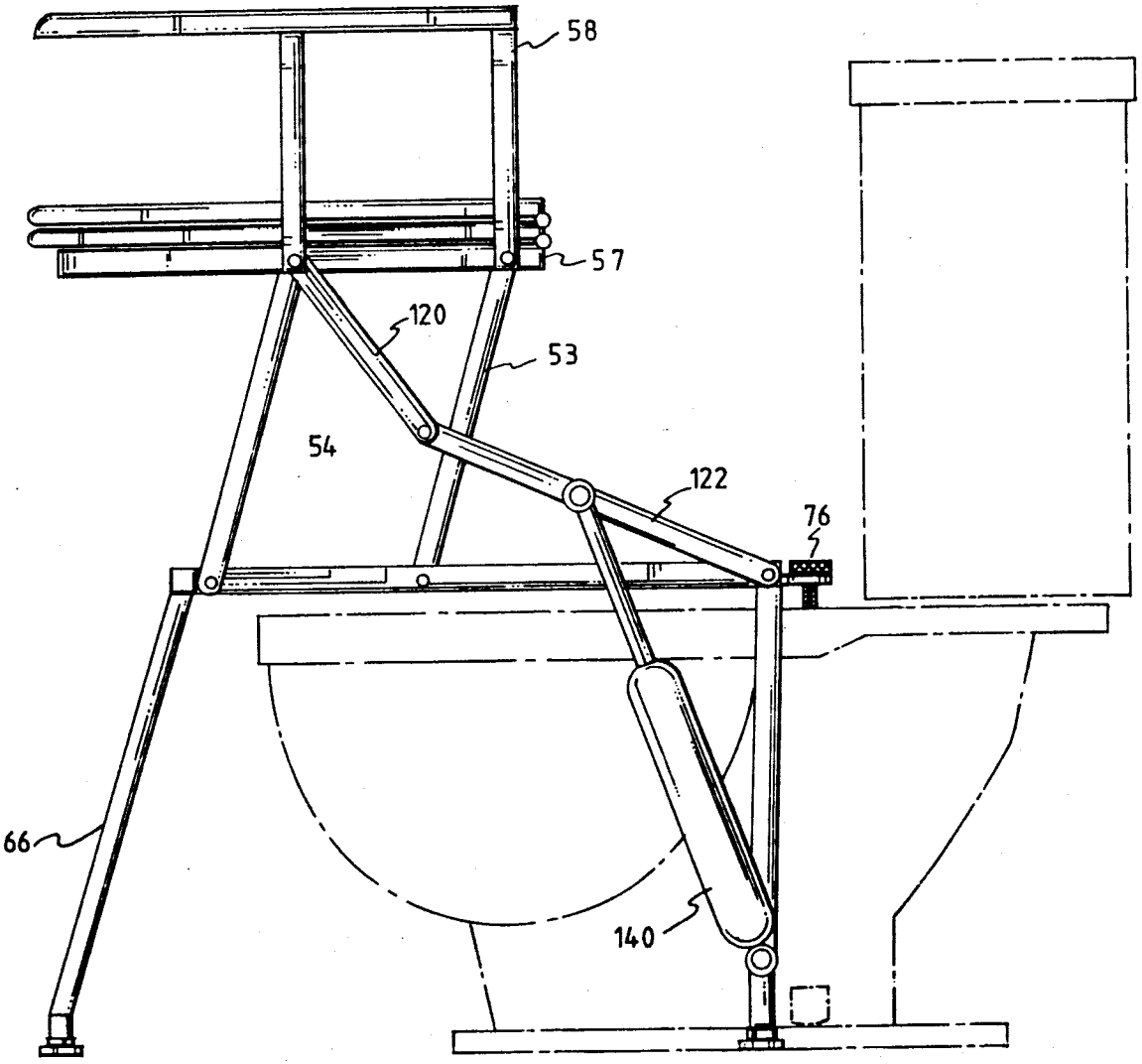
FIG. 8 is a side plan view of an alternative embodiment of the apparatus shown in FIG. 7. An air shock absorber is used instead of the motor-driven worm drive.
Figure 9:
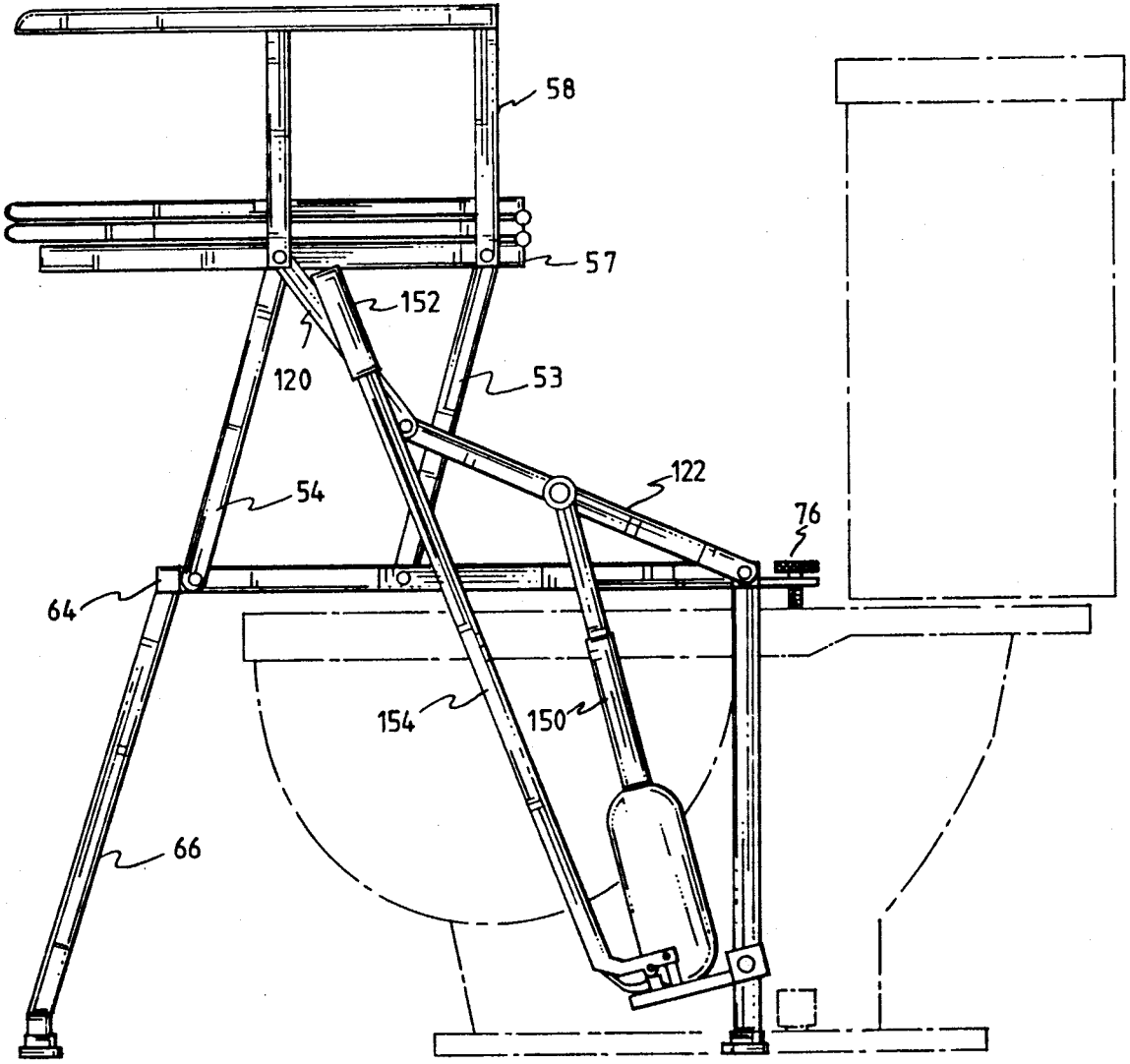
FIG. 9 is a side plan view of an alternative embodiment of the apparatus shown in FIG. 11. A hand-driven hydraulic pump is used instead of the motor-driven worm drive.

Referring to FIG. 7–9, the lid and seat of the movable toilet seat are attached to the upper frame base 57 by conventional means, although such means may require alteration (such as the addition of another hinge) of the usual off-the-shelf toilet seat.

Figure 4:
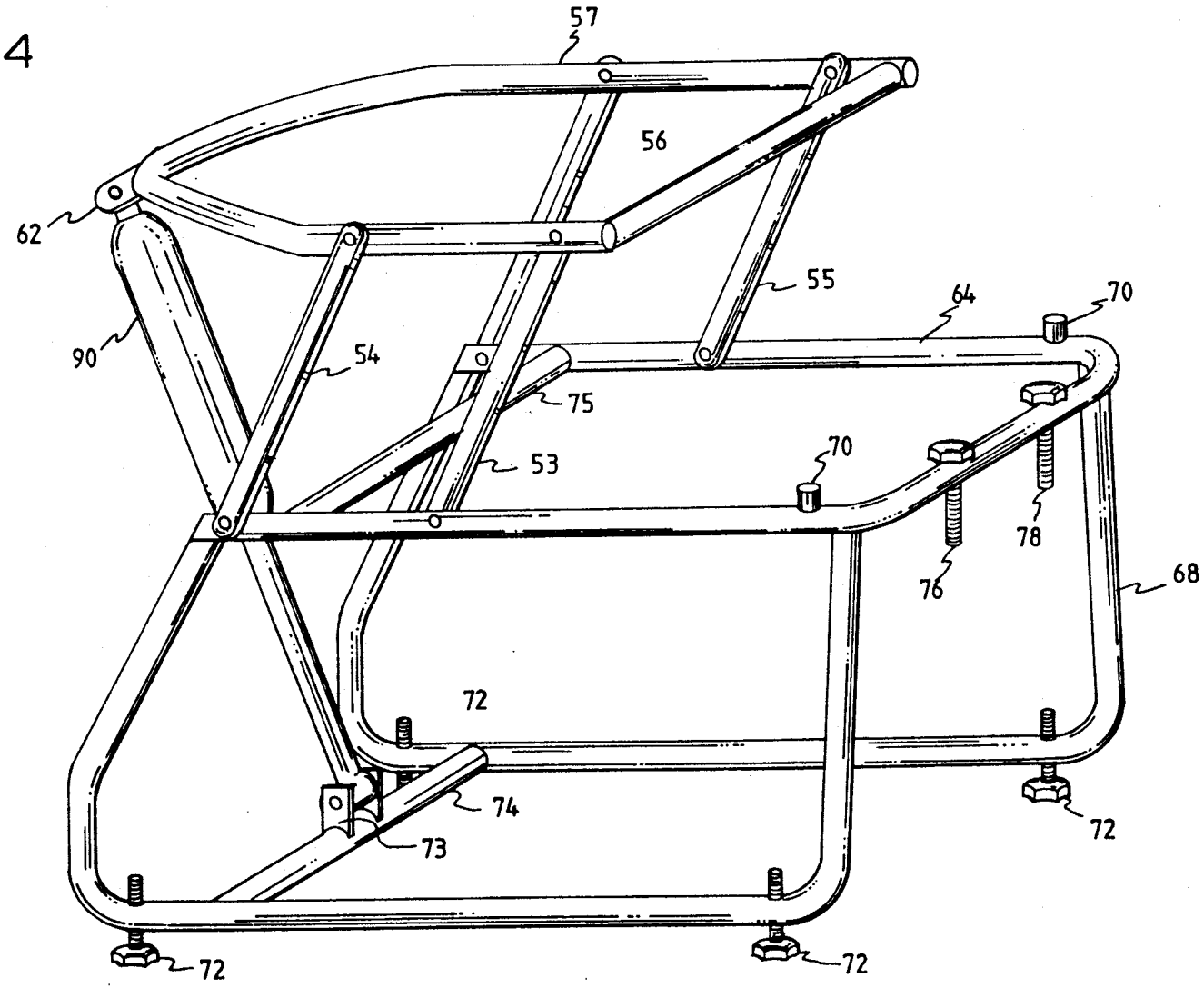
FIG. 4 is an alternative embodiment of the present invention showing an air shock absorber lifting the upper frame.

Referring to FIG. 4, an alternative embodiment of the present invention is shown. Instead of a reversible motor 80 with screw 82 and screw follower 84, an air shock absorber 90 is used. The air shock absorber 90 is pivotally attached at one end to the housing 62 and at the other end to the bracket 73. A switch-controlled air compressor (not shown) is used to inflate the air shock absorber 90 with air. When inflated with air, the air shock absorber 90 extends itself to push and hold up the upper frame base 57. In order to lower the upper frame base 57, air is released from the air shock absorber 90 by such conventional means as a solenoid switch controlled by the same means that control the air compressor.

Figure 5:
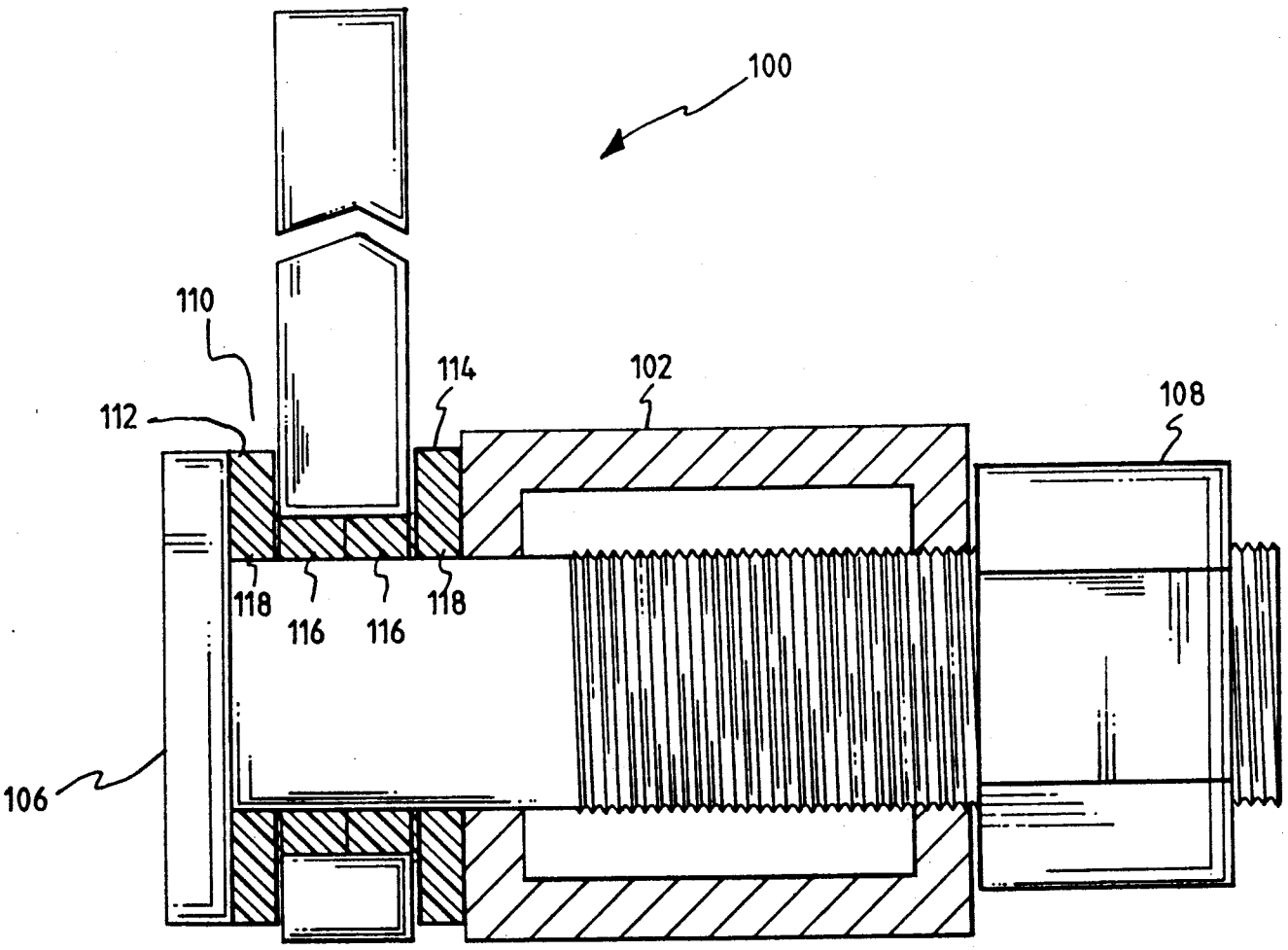
FIG. 5 is a cross-sectional view of a pivot for rectangular tubular frames.
Figure 6:
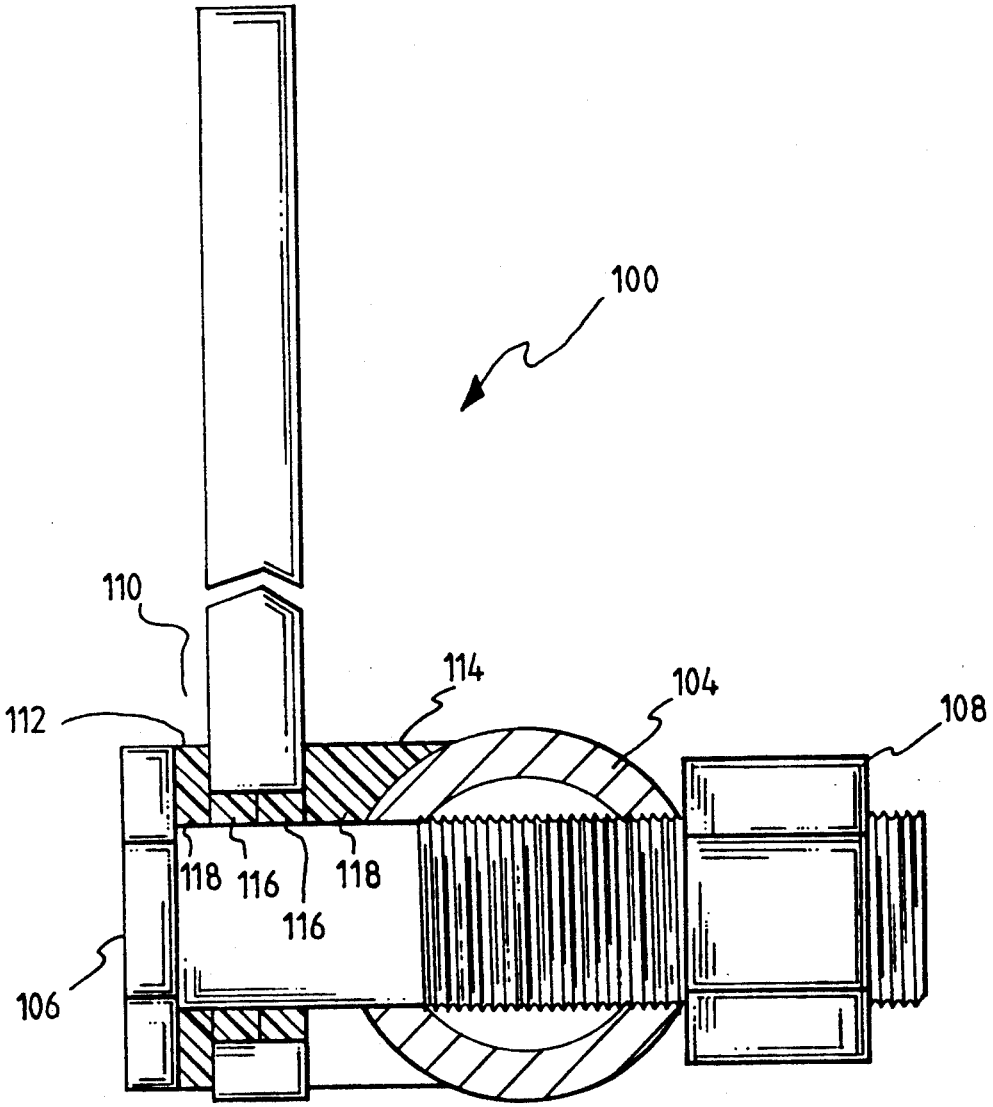
FIG. 6 is a cross-sectional view of a pivot for preferred circular tubular frames.

Referring to FIGS. 5 and 6, different exemplary bearing structures usable in the present invention are shown.

Figure 2:
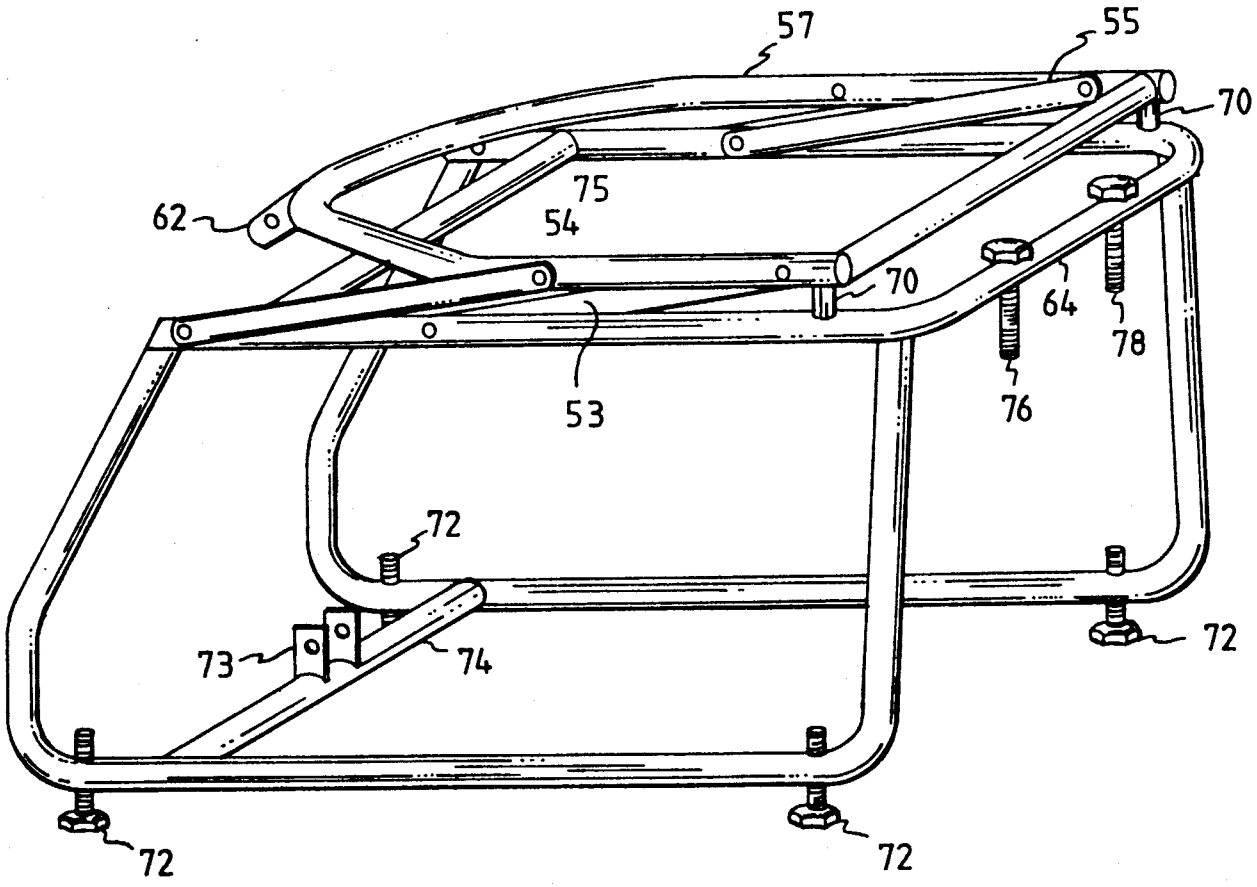
FIG. 2 shows a perspective view of the present invention in a lowered position without means for raising or lowering the upper frame.

In FIGS. 5 and 6, 2 different strut bearings 100 are shown. The significant difference between the two embodiments is that FIG. 5 shows a bearing for a strut connected to a square tube 102 while FIG. 6 shows a bearing for a strut connected to a preferred round tube 104.

Both Figures have bolts 106 held in place by nuts 108. Nylon or other self-lubricating bushings 110 are used to allow the strut to turn about the bolt 106. The bolt 106 passes through the bushings 110, the strut, the frame tube 102/104, and finally the nut 108. The bushings 110 have two portions to them. An outer bushing 112 and an inner bushing 114.

Both outer 112 and inner 114 bushings are the same when a square frame tube 102 is used. In this case, each bushing has a portion 116 that fits within the hole in the strut and has an outer portion 118 that fits between the strut and either the frame tube 102/104 or the bolt 106 head, depending on the placement of the bushing 110. For both bushing placements, the surfaces of the bushing 110 match the adjacent structure, either bolt 106, strut, or frame tube 102/104. For the preferred circular frame tube 104, the outside surface of the inner bushing 114 matches the contour of the circular frame tube 104.

The bushing 110 has a central aperture through which the bolt 106 passes. Likewise, the frame tube 102/104 has a hole through which the bolt 106 passes. Upon threading the bolt 106 through the strut and bushing 110, and the frame tube 102/104, the nut 108 is sufficiently tightened to prevent the bolt 106 from coming loose. The two inner portions 116 of the bushing 110 are compressed and held together between the bolt 106 head and the frame tube 102/104. The strut is held in place by the outer 112 and inner 114 portions of the bushing 110. The strut rotates about the bushing 110 and only comes into contact with the bushing 110 surface.

Referring now to FIGS. 7–9, in another alternative embodiment of the present invention, a single drive mechanism raises and lowers the upper frame base 57 from the side of toilet In order to lift the upper frame 50, two pivotally connected levers are used. A shorter lever 120 is pivotally connected to the upper frame 50 at the same point where the front strut 54 is connected to the upper frame base 57. A longer lever 122 is pivotally connected at one end to the other end of the shorter lever 120. The other end of longer lever 122 is pivotally connected to the lower frame 52 at the rear of lower frame base 64. The lengths of shorter 120 and longer 122 levers may be optimized to use the greatest mechanical advantage available.

The mechanism used to raise and lower the upper frame 50 is located to the side of the toilet. FIG. 7 shows a reversible motor 130 that pivots upon the back leg. For the reversible motor 130, additional levers are used. An upper lever 132 is pivotally connected at one end to the longer lever 122. The other end of the upper lever 132 is pivotally connected to both a screw follower 134 and one end of the lower lever 136. The other end of lower lever 136 is pivotally connected to the back leg.

Threaded through the screw follower 134 is a screw 138 that is driven by reversible motor 130. The screw 138 turns clockwise or counter-clockwise in response to motor 130. When the screw 138 turns, the screw follower 134 moves in or out upon the screw 138. The common pivot of upper lever 132 and lower lever 136 is moved along with the screw follower 134. As the common pivot is moved away from the reversible motor 130, the upper frame 50 is lowered. As the common pivot is moved towards the reversible motor 130, upper frame 50 is raised. The reversible motor 130 is controlled by a switch (not shown).

For FIGS. 8 and 9, extension devices are used to raise and lower the upper frame 50. In FIG. 8, an air shock absorber 140 moves longer lever 122 towards or away from itself 140, lowering or raising the upper frame 50, respectively. The air shock absorber 140 is pivotally connected to longer lever 122 at one end and the back leg at the other. An air compressor (not shown) supplies the air shock absorber 140 with air to raise the upper frame 50, and a solenoid switch or similar device allows air to escape from the air shock absorber 140 to lower the upper frame 50.

In FIG. 9, a hand-driven jack 150 is shown pivotally connected at one end to the longer lever 122 and at the other end to the back leg. Handle 152 is twisted to controllably lower the upper frame 50 when a person is seated thereon, or a spring (not shown) can be connected between upper 57 and lower 64 frames to accomplish the same effect. To raise the upper frame 50, the handle 152 is twisted to prevent the jack 150 from lowering the upper frame 50, and the bar 154 is pumped back and forth to extend the jack's 150 reach.

For the embodiments shown in FIGS. 7–9, the driving mechanisms are located to only one side of the toilet. Support and driving force need to be transmitted from one side of the toilet seat mechanism to the other so that both sides are lifted equally.

Figure 10:
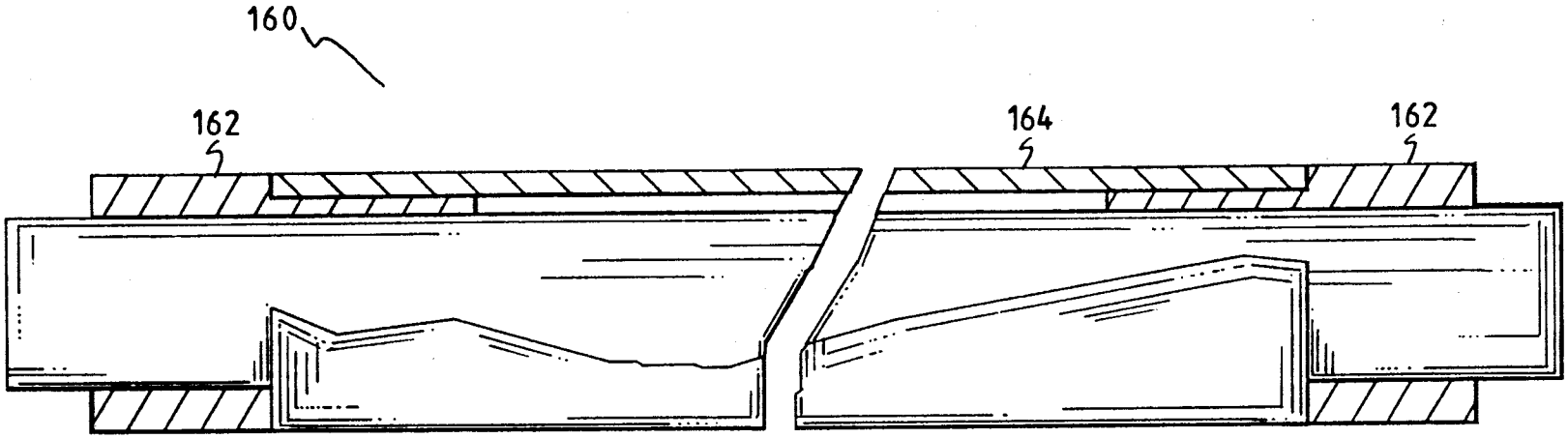
FIG. 10 is a cross-sectional view of the joint for an alternative embodiment using one side mechanism for raising and lowering the upper frame, such as those in FIGS. 11–13.
Figure 11:
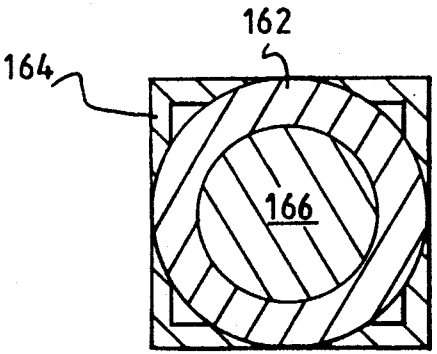
FIG. 11 is a cross-sectional view of the joint shown in FIG. 10.

In FIGS. 10 and 11, a bearing is shown that helps to provide equal lift for both sides of toilet seat mechanisms as are shown in FIGS. 7–9. The bearing is located where the longer lever 122 pivotally connects to the lower frame base 64. The pivoting of the longer lever 122 is communicated to a similar longer-shorter lever structure (not shown) on the other side of the toilet seat mechanism.

FIG. 10 shows in cross section the length of the bearing 160. End caps 162 are made of bronze and fit within a stainless steel tube 164. Connected to the longer levers 122 and turning within the tube 164 and end caps 162 is a second tube 166. When the longer lever 122 pivots, second tube 166 turns and forces the other corresponding longer lever to pivot as well. FIG. 11 shows in widthwise cross section the bearing shown in lengthwise cross section of FIG. 10.

While the present invention has been described with 1 0 regards to particular embodiments, it is recognized that additional variations of the present invention may be devised without departing from the inventive concept.

What is claimed is:

1. A movable toilet seat, comprising:

a lower frame;

an upper frame to which a toilet seat may be attached and upon which a person may stably be seated, said upper frame moving relatively forward of said lower frame when said upper frame is raised;

means for connecting said upper frame to said lower frame, said connecting means pivotally attached to said upper and lower frames so that said upper frame is kept horizontal when said upper frame moves relative to said lower frame; and means for moving said upper frame relative to said lower frame, said moving means connected to said upper frame.

2. The movable toilet seat of claim 1, wherein said connecting means further comprises:

at least one strut.

3. The movable toilet seat of claim 1, wherein said connecting means further comprises:

a plurality of struts, each of said struts of equal length.

4. The movable toilet seat of claim 1, wherein said moving means further comprises:

a screw follower, said screw follower pivotally connected to said upper frame;

a screw, said screw turning within said screw follower; and a reversible motor, said reversible motor turning said screw.

5. The movable toilet seat of claim 1, wherein said moving means further comprises an air shock absorber.

6. A movable toilet seat comprising:

a lower frame;

an upper frame to which a toilet seat may be attached and upon which a person may stably be seated, said upper frame moving relatively forward of said lower frame when said upper frame is raised;

a plurality of struts of equal length connecting said upper frame to said lower frame, said plurality of struts each pivotally connected to said upper and lower frames so as to define a parallelogram so that said upper frame is kept horizontal when said upper frame moves relative to said lower frame and said plurality of struts not passing through an angle defined with respect to said lower frame of greater than ninety degrees; and means for moving said upper frame relative to said lower frame, said moving means pivotally coupled to said upper frame.

7. The movable toilet seat of claim 6, wherein said means for moving said upper frame further comprises:

a screw follower pivotally coupled to said upper frame;

a screw turning within said screw follower; and a reversible motor driving said screw.

8. The movable toilet seat of claim 6, wherein said means for moving said upper frame further comprises: an air shock absorber.

9. The movable toilet seat of claim 6, wherein said means for moving said upper frame further comprises: a manually operated jack.

* * * * *